United States Patent [19]

Grindle et al.

[11] 4,175,282

[45] Nov. 20, 1979

[54] LUMINAIRE ATTACHMENT DEVICE

[75] Inventors: James L. Grindle; Walter R. Blake, both of Hendersonville, N.C.

[73] Assignee: General Electric Company, Schenectady, N.Y.

[21] Appl. No.: 916,647

[22] Filed: Jun. 19, 1978

[51] Int. Cl.[2] ..... F21S 1/10

[52] U.S. Cl. ..... 362/363; 362/374; 362/375; 362/378

[58] Field of Search ..... 362/363, 378, 374, 376, 362/375

[56] References Cited

U.S. PATENT DOCUMENTS 3,826,912 7/1974 Pomroy ..... 362/378

*Primary Examiner*—Stephen J. Lechert, Jr.

*Attorney, Agent, or Firm*—Sidney Greenberg

[57] ABSTRACT

Device for readily removable attachment of globe and protective guard to lighting fixture. Threaded collar of fixture support has elongated spring member with central mounting loop and opposite ends formed with yieldable detent portions for separately engaging and removably holding luminaire globe and protective guard mounted in the threaded support collar.

8 Claims, 9 Drawing Figures

LUMINAIRE ATTACHMENT DEVICE

The present invention relates to luminaires, and more particularly concerns luminaires of hazardous duty type having a globe and protective guard attached thereto.

It is an object of the invention to provide a luminaire of the above type having an improved attachment device for readily attaching and detaching the globe and protective guard without the use of tools.

Another object of the invention is to provide a simple attachment device of the above type which firmly holds the globe and protective guard in assembly with the luminaire and enables the assembly to withstand the effects of vibration and shock under operating conditions.

A further object of the invention is to provide an attachment device of the above type which does not hinder ready removal of the attached luminaire components for maintenance and replacement.

Other objects and advantages will become apparent from the following description and the appended claims.

With the above objects in view, the present invention in one of its aspects relates to a luminaire comprising, in combination, support means comprising a socket having a screw-threaded wall defining a socket bore open at one end, the wall having an opening extending transverse the threads thereof and having an end face at the open end, an elongated spring member having an intermediate mounting portion and opposite end portions, the spring member secured to the socket end face with one end portion received in the transverse wall opening and normally protruding therefrom into the socket bore, the opposite end portion of the spring member extending along the end face of the wall and formed with a transverse catch portion, a globe having an open top threadably engaging the screw-threaded socket wall and yieldably engaged by the protruding spring end portion for firmly holding the globe in removable assembly in the socket, and a cage-like guard having an open end secured to the support means and extending around the globe, the support means having inwardly directed flange means at the open end of the socket, the guard formed at its open end with a shoulder portion, the guard being rotatable in one direction relative to the support means with the shoulder portion engaging the flange means for moving the guard into attached position, the shoulder portion formed with detent means engaged by the spring catch portion for yieldably holding the guard in attached position on the support means, the guard being rotatable in the opposite direction for releasing the detent means thereof from the spring catch portion for removing the guard from the attached position.

The invention will be better understood from the following description taken in conjunction with the accompanying drawings, in which.

Figure 1:
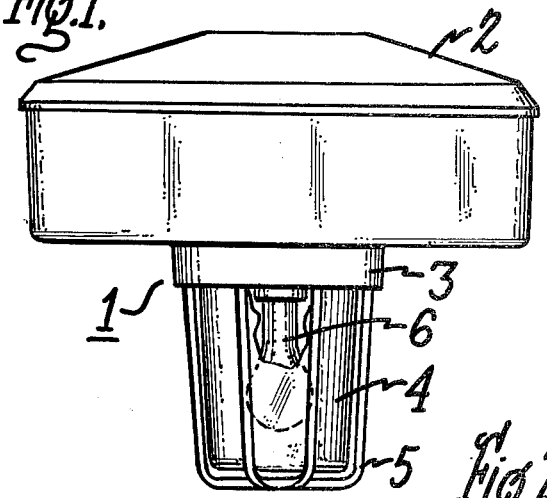
FIG. 1 is a view in elevation of a hazardous duty luminaire in which the invention may be embodied.
Figure 2:
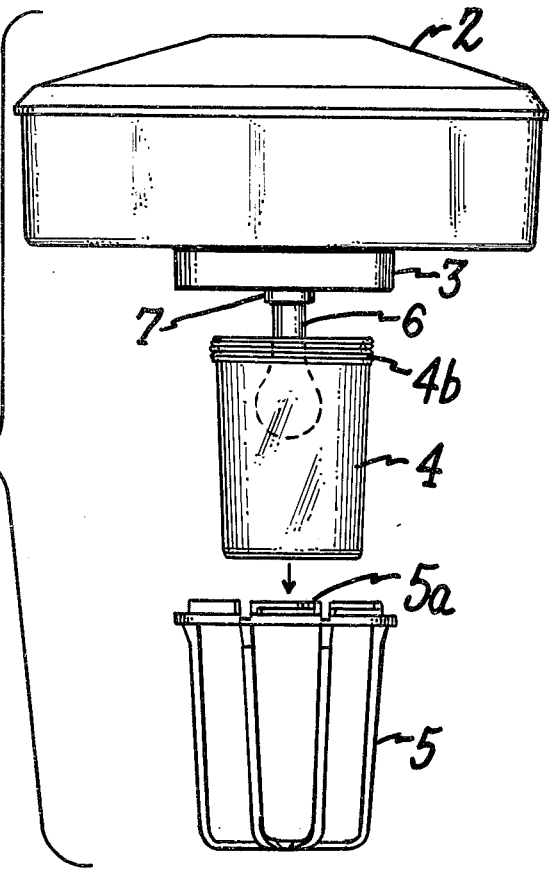
FIG. 2 is an exploded view of the FIG. 1 luminaire showing the luminaire globe and its guard spaced from their support socket on the upper luminaire housing.

Referring now to the drawings, and particularly to FIGS. 1 and 2, there is shown a luminaire 1 of hazardous duty type comprising a ballast housing 2 having a collar 3 secured at the bottom thereof and forming a shallow support socket for receiving and removably holding transparent globe 4 and cage-like metal guard 5 surrounding the globe. Globe 4 encloses lamp 6, typically a high intensity gaseous discharge lamp, which is mounted at its upper (base) end in electric socket 7 within collar 3 and extends downwardly therefrom along a vertical axis about which globe 4 and protective guard 5 are substantially concentric. Ballast housing 2 contains electrical components (not shown) for operating discharge lamp 6.

Figure 3:
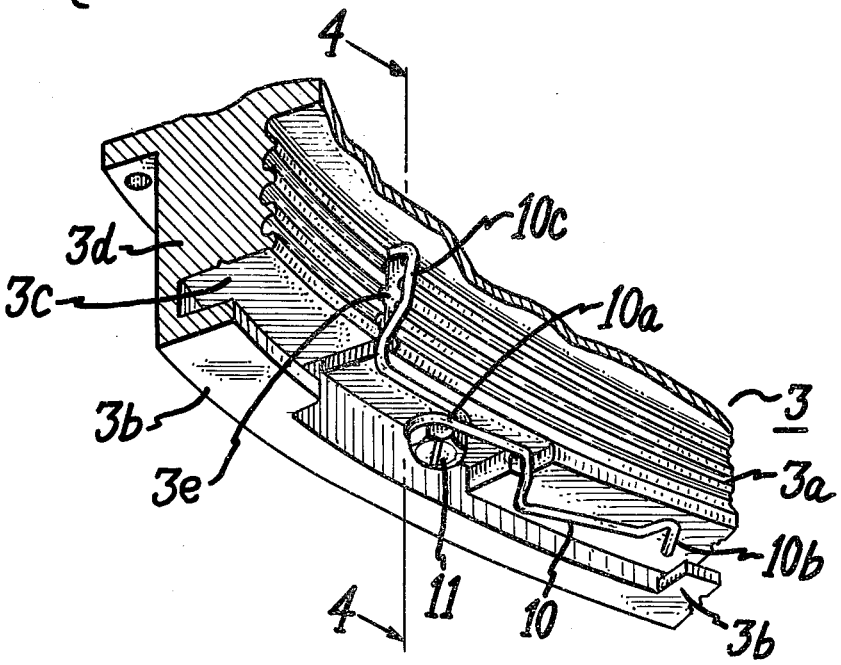
FIG. 3 is a fragmentary perspective view in enlarged scale of the support socket showing the retaining device for the luminaire globe and guard in accordance with an embodiment of the invention.
Figure 8:
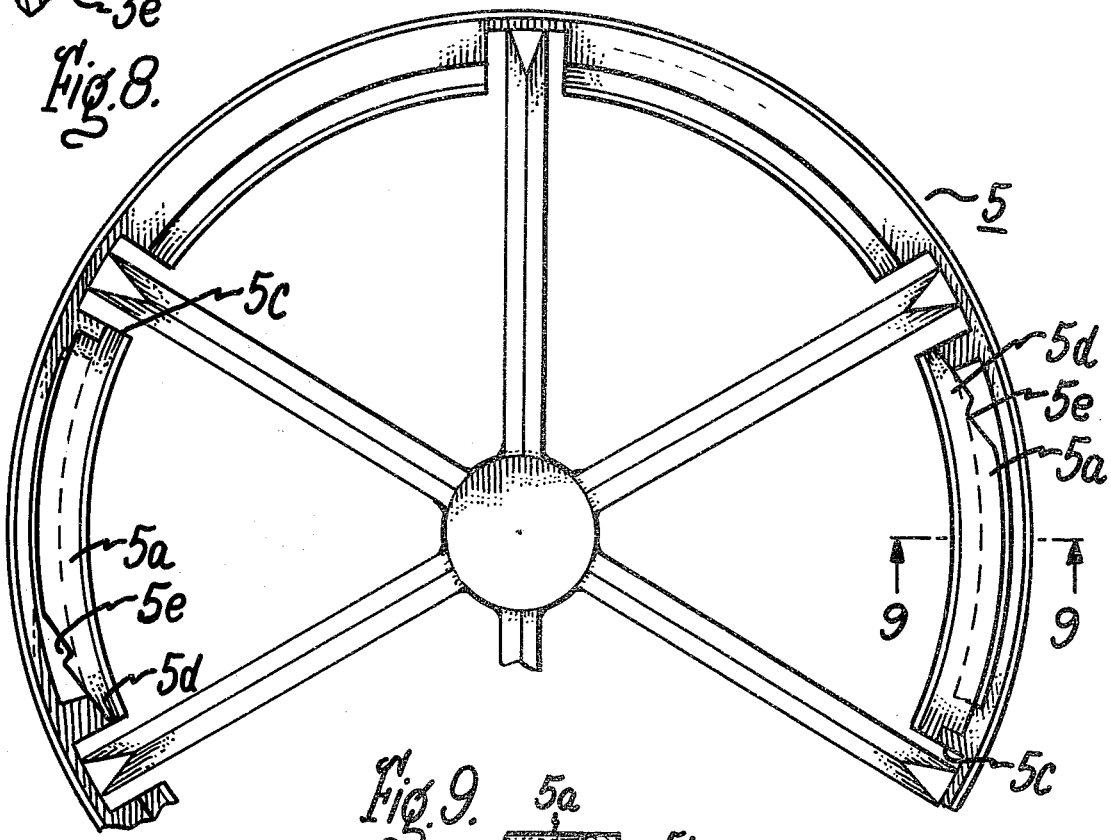
FIG. 8 is a top plan view in enlarged scale of the globe guard shown in FIG. 2.
Figure 9:
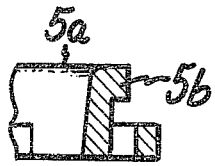
FIG. 9 is a detail view in cross-section of a portion of the protective guard, taken along the line 9—9 of FIG. 8.

As seen in FIG. 3, support socket 3 is formed with screw-threads 3*a* on its internal surface, and globe 4, which is typically made of glass, is formed adjacent its open upper end with external threads 4*b*, so that the globe may be screwed into housing socket 3 to install it in position around lamp 6. Socket 3 is formed at its bottom with circumferentially spaced flanges 3*b* projecting inwardly below bottom end face 3*c* of threaded socket wall 3*d*. Protective guard 5 is formed at its top edge with a pair of upwardly projecting arc-shaped shoulders 5*a* arranged diametrically opposite one another (see FIGS. 2 and 8). As seen in the cross-sectional view of FIG. 9, shoulders 5*a* are formed at their top with an outwardly projecting flange 5*b*. At their front ends, each shoulder 5*a* is formed with a tapered portion 5*d* and a recess 5*e* spaced rearwardly therefrom. In the assembly of guard 5 with the support socket 3, the guard is moved upward into socket 3 with its shoulders 5*a* inserted into entrance slots 3*e* between socket flanges 3*b*, as indicated by the interrupted lines in FIG. 7, and the guard is rotated clockwise as viewed in FIG. 7 with flanges 5*b* inserted in the space between socket flange 3*b* and the bottom end face 3*c* of threaded socket wall 3*d*, so that guard flange 5*b* rides on socket flange 3*b* during such rotation. Rear surface 5*c* of each shoulder 5*a* serves as a stop which prevents clockwise rotation of guard 5 by abutting the edge of socket flange 3 in the event of such rotation.

Figure 5:
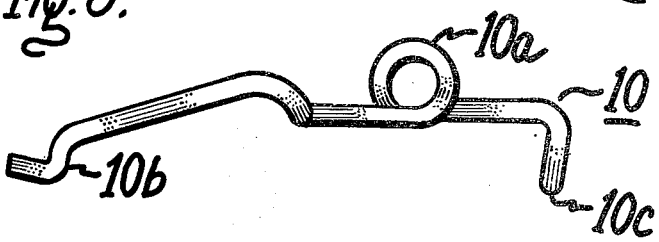
FIG. 5 is a plan view of the spring retaining device employed in the FIG. 3 embodiment.
Figure 6:
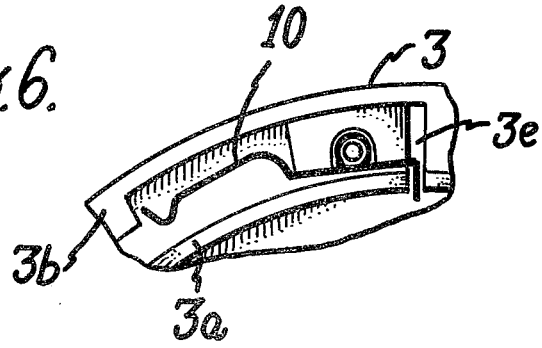
FIG. 6 is a plan view in reduced scale of the spring retaining device in assembly on the support socket.
Figure 4:
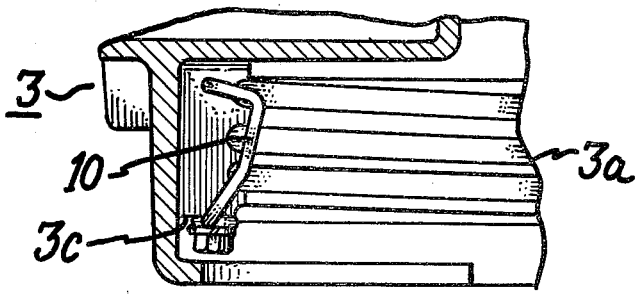
FIG. 4 is a sectional view in somewhat enlarged scale of the socket structure shown in FIG. 3 taken along the line 4—4.

In accordance with the invention, a dual function wire spring 10 having the form shown in FIG. 5 is secured to the bottom end face 3*c* of socket wall 3*d*, the spring being constructed and arranged to firmly and resiliently hold both globe 4 and protective guard 5 in assembled position in housing socket 3. As seen in FIGS. 3 and 5, wire spring 10 has a substantially flat loop 10*a* formed in its intermediate portion, a V-shaped catch portion 10*b* at one end, and a bent bearing portion 10*c* at its other end (see FIG. 3) extending in a plane transverse the planes of loop portion 10*a* and catch portion 10*b*. As seen in FIG. 3, spring 10 is secured to socket wall 3*d* by a screw 11 or the like passing through spring loop 10*a* and screwed into socket end face 3*c*, with the spring end portion having catch 10*b* extending along end face 3*c* and the opposite end portion comprising bent member 10*c* partially inserted into slot 3*e* in threaded socket wall 3*d* so that the yieldable bearing member 10*c* projects outwardly from the slot, as seen best in FIG. 4. In a typical arrangement, a similar spring member (not shown) is mounted on socket wall 3*d* diametrically opposite the described spring member.

In the operation of the disclosed device, when globe 4 is screwed into socket 3, its upper threaded portion comes into contact with spring bearing member 10*c*, pushing the protruding portion of the latter partially into slot 3*e*. Bearing member 10*c* thereby exerts sufficient resilient pressure against the threaded portion of globe 4 to effectively prevent loosening of globe 4 from the support socket 3 due to vibration or other operating conditions, while still permitting the globe to be readily unscrewed for removal from the socket.

Figure 7:
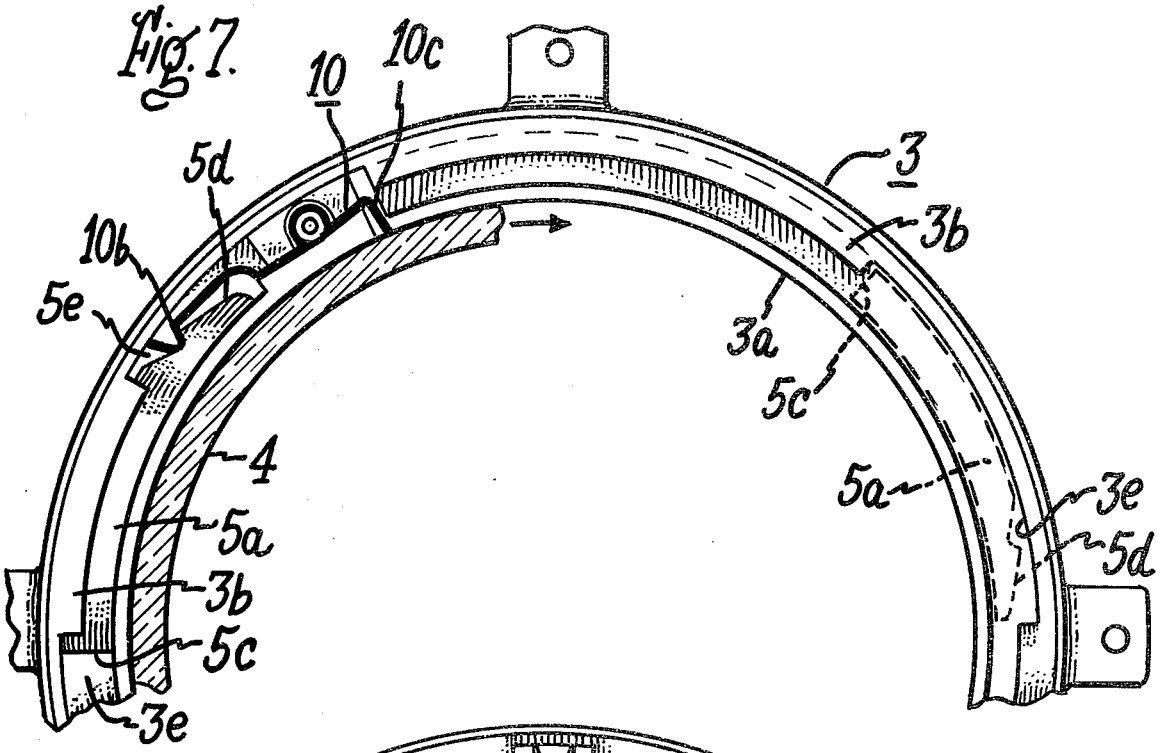
FIG. 7 is a bottom plan view in enlarged scale of a portion of the support socket showing portions of the globe and guard in assembly therewith.

When protective guard 5 is inserted into socket 3 enclosing globe 4 and rotated clockwise as viewed in FIG. 7, as previously described, the tapered leading end 5*d* of each shoulder comes into contact with spring catch 10*b* of the respective springs and with continued rotation displaces and rides past the latter until catch 10*b* snaps into recess 5*e* of the shoulder. Recess 5*e* has a shape complementary to the shape of catch 10*b*, so that when the latter is seated in the recess, guard 5 is effectively held in assembled position and can withstand vibration and impact conditions encountered in typical installations without tending to rotate out of its assembled position. The arrangement is such, however, that guard 5 may be readily manually rotated counter-clockwise to disengage the recessed shoulders from the spring catches 10*b* for removal of the guard from the fixture.

There are thus provided by the invention means for readily and rapidly removing the globe and the protective guard of hazardous duty luminaires without the use of tools to allow relamping, cleaning of the globe, and other maintenance procedures, while providing secure attachment of these parts to the lighting fixture.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A luminaire comprising, in combination, support means comprising a socket having a screw-threaded wall defining a socket bore open at one end, said wall having an opening therein, an elongated spring member having an intermediate mounting portion and opposite end portions, said spring member secured to said socket wall with one end portion received in said wall opening and normally protruding therefrom into said socket bore, the opposite end portion of said spring member extending along said wall and formed with a catch portion, optical means having an open top threadably engaging said screw- threaded socket wall and yieldably engaged by said protruding spring end portion for firmly holding said optical means in removable assembly in said socket, and a cage-like guard having an open end secured to said support means and extending around said optical means, said support means having inwardly directed flange means at the open end of said socket, said guard formed at its open end with a shoulder portion, said guard being rotatable in one direction relative to said support means with said shoulder portion engaging said flange means for moving said guard into attached position, said shoulder portion formed with recess means engaged by said spring catch portion for yieldably holding said guard in attached position on said support means, said guard being rotatable in the opposite direction for releasing said recess means thereof from said spring catch portion for detaching said guard from said attached position.

2. A luminaire as defined in claim 1, said optical means comprising light transmitting globe means.

3. A luminaire as defined in claim 2, said wall opening extending transverse the wall threads, said socket having an end face at said open end, said spring member secured to said socket end face with said opposite end portion of said spring member extending along said socket end face, said one end portion of said spring member extending transverse the plane of said catch portion.

4. A luminaire as defined in claim 3, said intermediate mounting portion of said spring member comprising a loop formed in said spring member, and fastening means passing through said loop securing said spring member to said socket end face.

5. A luminaire as defined in claim 4, said shoulder portion of said guard having a tapered leading end adjacent said recess means for engaging and displacing said spring catch portion prior to engagement of the latter portion with said recess means.

6. A luminaire as defined in claim 5, said socket having mounted thereon a plurality of circumferentially spaced spring members of the defined construction and arrangement, said guard formed with a plurality of circumferentially spaced shoulder portions of the defined construction and arrangement for coacting respectively with said plurality of spring members.

7. A luminaire as defined in claim 2, said support means comprising an electrical ballast housing having said socket secured to the bottom thereof.

8. A luminaire as defined in claim 2, said socket having means for mounting a lamp therein extending through said socket bore.

* * * * *